United States Patent [19]

Hukki

[11] 4,248,699

[45] Feb. 3, 1981

[54] PNEUMATIC CLASSIFIER

[75] Inventor: Risto T. Hukki, Espoo, Finland

[73] Assignee: Kennedy Van Saun Corporation, Danville, Pa.

[21] Appl. No.: 82,946

[22] Filed: Oct. 9, 1979

Related U.S. Application Data

[63] Continuation of Ser. No. 919,251, Jun. 26, 1978, abandoned.

[30] Foreign Application Priority Data

Jul. 9, 1977 [GB] United Kingdom ..... 28890/77

[51] Int. Cl.[3] ..... B04C 3/00

[52] U.S. Cl. ..... 209/144; 209/154

[58] Field of Search ..... 209/144, 211, 143, 139 R, 209/154, 139 A; 210/512 R, 512 M; 55/461, 459 R

[56] References Cited

U.S. PATENT DOCUMENTS

| | | | |
|---|---|---|---|
| 2,767,840 | 10/1956 | Dobson et al. | 209/144 |
| 3,311,234 | 3/1967 | Rumpf et al. | 209/139 R X |
| 3,672,503 | 6/1972 | Mark | 209/144 |
| 3,693,791 | 9/1972 | Beck | 209/144 |
| 3,878,091 | 4/1975 | Hukki | 209/144 X |
| 3,948,771 | 4/1976 | Bielefeldt | 55/461 X |

FOREIGN PATENT DOCUMENTS

| | | | |
|---|---|---|---|
| 455753 | 6/1975 | U.S.S.R. | 209/144 |

*Primary Examiner*—Ralph J. Hill
*Attorney, Agent, or Firm*—Brumbaugh, Graves, Donohue & Raymond

[57] ABSTRACT

A pneumatic classifier and process in which a stream of fluid and the material to be classified are introduced in a swirling stream into a classification chamber, the coarser material migrates by centrifugal force to the outer portion of the stream, the inner and outer portions of the stream are divided, the outer portion of the stream containing the coarser particles is discharged from the classification chamber through a substantially tangential discharge passage, the inner portion of the stream is swirled in a closed path within the classification chamber, the finer particles are discharged from the classification chamber through a discharge passage which communicates with the region within the swirling stream and the recycled coarser particles rejoin the incoming swirling stream where they migrate outwardly by centrifugal force toward the outer stream.

3 Claims, 1 Drawing Figure

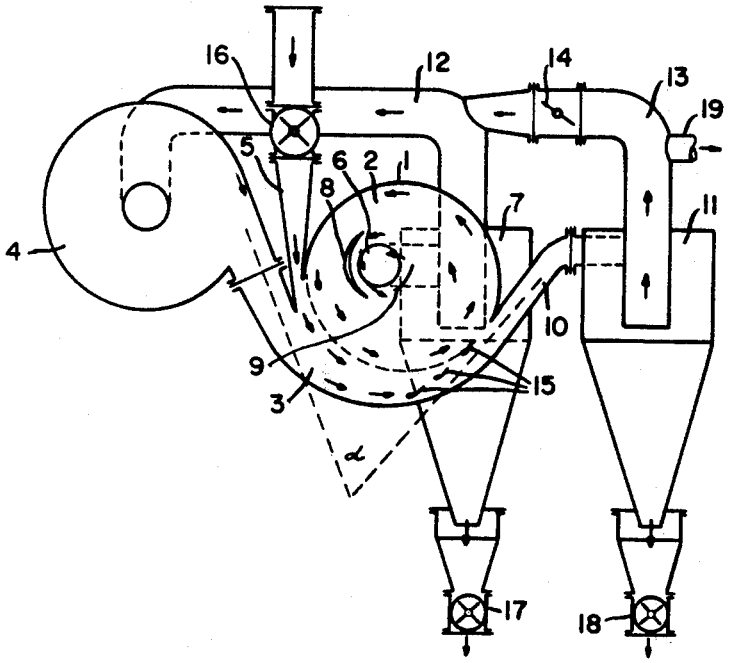
16
12
14
13
19
5
6
2
1
8
7
11
4
10
9
15
3
α
17
18

PNEUMATIC CLASSIFIER

This is a continuation of application Ser. No. 919,251, filed June 26, 1978, now abandoned.

This invention relates to a pneumatic classifier and process for classifying dry powdered solids of extreme fineness, for exmple, micropowders in the order of 99% below 10 microns, on an industrial scale.

The classifiers conventionally used for industrial production of micropowders are mechanical separators which normally include a rotor driven at high speed in order to create the strong centrigual field required. The design and construction of such separators is complicated due to the high mechanical precision and balance required. It is characteristic of such separators that their fine product production rate is low and their energy consumption in terms of KWH/ton of fine product is high. Also, they require extensive auxiliary equipment. As a result, such classifying systems are expensive to acquire and expensive to use.

In contrast, the pneumatic classifier of the present invention is simple and inexpensive. The classifier proper has no moving internal parts. The centrifugal field required can be provided by a conventional blower, and the rotor of the blower need be the only driven component of the classifier system. The fine product production rate is high and the energy consumption is low by comparison with conventional classifying systems. Since the apparatus requires no precision parts, it is simple to build and inexpensive to operate.

In the pneumatic classifier and process of the present invention a stream of air or other pneumatic fluid and the material to be classified are introduced in a swirling stream into a classification chamber, coarser material migrates by centrifugal force to the outer portion of the stream, the inner and outer portions of the stream are divided, the outer stream containing the coarser particles is discharged from the classification chamber through a substantially tangential discharge passage, the inner portion of the stream swirls in a closed path within the classification chamber, the finer particles are discharged from the classification chamber through a discharge passage which communicates with a region within the swirling stream and the coarser particles are recycled back into the incoming swirling stream where they migrate outwardly by centrifugal force toward the outer stream.

The novel classification apparatus and process utilizes the pneumatic fluid stream to perform two functions simultaneously. The pneumatic stream carries with it the material to be classified and, after flowing in a short arcuate, swirling path through the classification chamber, is divided into two component streams within the classifier. The inner portion or layer of the suspension is directed in a swirling path within the classifier, carrying by drag force a load of the fine particles from which the oversize particles are separated in the centrifugal field, while the very finest particles below a selected cut size remain in suspension and are carried away from the classification space through a fine product discharge passage from the central portion of the swirling stream. The outer portion or layer of the pneumatic fluid stream which contains chiefly particles of the feed coarser than the selected size flows at high speed along an outer path within the classifier housing, although somewhat retarded by friction from the classifier housing, and this divided outer stream carries the coarser particles through a substantially tangential discharge passage from the classification chamber.

In order to provide space for the division of the streams and the indicated phenomena to take place unhindered, an enlargement of the generally circular classification chamber is provided in a preferred embodiment of the invention adjacent the lower region of the classification space proper. This enlargement is in acruate portion adjacent and communicating with the lower region of the circular chamber and having a larger inlet and a smaller discharge. The pneumatic fluid stream and the material to be classified are introduced into the wider feed end of this enlargement. Two ways exist for the coarse particles to get into the lower stream or layer. First, the coarser, heavier particles can be rejected into the lower outer layer by centrifugal force created in the enlargement almost immediately upon introduction of the material into the fluid stream, and these coarser, heavier particles will be immediately discharged from the classification chamber. Secondly, those oversize particles that are not immediately rejected but are carried in a swirling motion within the classification chamber will proceed at a high, although somewhat retarded, speed along or near the outer periphery of the upper region of the classification chamber and ultimately join, more or less tangentially, the incoming material to be classified. As this coarser material is recycled through the enlargement portion of the classification chamber, it travels outwardly by centrifugal force, entering the outer stream with which it is discharged from the classification chamber. The size of the finer material can be controlled by regulation of the division between the two streams.

The finer and coarser materials are preferably introduced into fine and coarse particle cyclones where the pneumatic fluid is separated fom the products and returned to the intake of the blower for recirculation with any particles with it.

For a more complete understanding of the present invention, reference can be made to the detailed description which follows and to the drawings, in which:

FIG. 1 is a schematic view illustrating the structure and operation of the present invention.

As shown in FIG. 1, the classifier apparatus of the present invention includes a classifier housing 1 containing a generally circular chamber 2 having a curved enlarged portion 3 below the chamber 2. The contour of the curved bottom of the enlarged portion simulates a curve drawn to the assumed full circle of the chamber 2, represented by the broken lines defining a larger inlet and a smaller discharge.

The discharges from a blower 4 and of a feed conduit 5 for the supply of the material to be classified are connected generally tangentially to the wider end of the enlargement 3. An eccentrically arranged discharge passage 6 from the classification chamber leads to a tangential inlet in the upper region of a fine product cyclone 7, providing a suction discharge from the classification chamber. Curved baffles 8 and 9 partially surround the access to the passage 6, and their outer surfaces define a swirl passage within the outer region of the chamber and the separations between the baffles 8 and 9 provide the entrances to the suction discharge passage 6. A generally tangential discharge passage 10 connects the narrower discharge end of the enlargement portion 3 with a tangential inlet in the upper region of a coarse product cyclone 11.

Conduits 12 and 13 connect the upper regions of the cyclones 7 and 11 to the intake of the blower 4 to establish a closed circulation system for the pneumatic fluid and the return of any particle dust carried with the fluid to the classification system. The conduit 13 contains a control valve or baffle 14 to regulate the return flow from the upper region of the cyclone 11.

The enlarged portion of the classification chamber includes a series of pivotally adjustable baffles 15 which regulate the flow pattern in the classification chamber. They are adjustable to divide the proportions of the fluid stream that are discharged from the classification chamber through the discharge passage 10 and that are swirled within the classification chamber 2. The adjustment of the baffles permits regulation of the proportions of coarse material delivered to the cyclone 11 and the fine material delivered to the cyclone 7.

The rotary valves 16, 17 and 18 provide auxiliary regulation means for operating the system and provide airtight seals to the ambient atmosphere. The rotary valve 16 meters the feed of the material to be classified into the classification chamber, feeding increments of feed as it rotates while at all times providing a seal for the system. The valves 17 and 18 regulate the discharge of fine and coarse material from the cyclones 7 and 11, respectively, discharging increments as they rotate while at all times providing a seal for the system. A take-off conduit 19 from the return conduit 13 connects the system to a dedusting or vacuum system (not shown) when desirable; at other times it can be closed off.

It is recommended that the angle $\alpha$ between the downward direction of the blower discharge or, that is to say, the direction of the main fluid stream leading into the enlarged portion of the classification chamber, and the upward direction of the outgoing coarse fraction discharge stream through the discharge passage 10 should be less than 90°.

Summarizing the operation, the rapidly flowing fluid stream delivered by the blower 4 and admitted into the enlargement 3 at a steep downwardly directed inclination draws the material to be classified from the feed conduit 5 into the enlargement 3 where a suspension is formed. The coarser particles entering the fluid stream are carried in a swirling motion through a relatively short arcuate path of the classification chamber. The centrifugal forces cause the coarser material to migrate outwardly and flow out the discharge passage 10 to the coarse product cyclone 11.

The upper or inner part of the suspension is directed upwardly into the upper region of the classification chamber 2 where the suspension is rapidly swirled about a horizontal axis along a path defined by the housing and the outer surfaces of the baffles 8, 9. Because there are no rotating internal parts within the chamber 2, the rotating motion is obtained and maintained solely by that part of the total fluid stream which is directed upwardly within the chamber. The rapidly rotating suspension creates an outwardly directed centrifugal field within the chamber 2. On the other hand, the portion of the fluid stream discharged via the discharge passage 6 and carried into the fine product cyclone 7 creates an inwardly directed drag force removing with it fine particles below a predetermined size. The fine product separates from the pneumatic fluid within the cyclone 7, and the product drops to the bottom, whereas the fluid is returned through the conduit 12 to the intake of the blower as explained above.

The particles coarser than the predetermined size which find their way into the upper region of the chamber 2 proceed in a swirling motion around the upper region of the chamber at high speed around the curved baffles 8 and 9 which prevent their short-circuit discharge into the discharge passage 6. The outer surfaces of these baffles maintain the swirling stream in a smooth flow pattern so that the rejected particles ultimately rejoin the incoming feed of particles to be classified in a more or less tangential fashion and assist the draw of the feed into the enlargement portion 3, imposing a strong dispersing shear on the agglomerates that may exist in the feed. As the recycled stream joins the incoming stream, the suspended particles therein have an opportunity once again to select their way into the inner or outer (upper of lower) regions of the stream swirling through the enlarged portion of the classification chamber. The coarser particles will tend to migrate outwardly under the influence of the centrifugal forces and find their way into the outer or lower part of the stream so that they will be discharged at high speed through the discharge passage 10 and collected in the coarse product cyclone 11.

As explained, the flow pattern within the classifier can be influenced by the baffles 15 within the enlarged portion 3, and these baffles regulate the distribution of the component streams ultimately directed to the fine product and coarse product cyclones 7 and 11, respectively. However, the principal control to regulate the distribution of the component medium streams directed to the fine product cyclone and the coarse product cyclone is provided by the valve or regulator 14 in the return conduit 13 which is the primary means to control the size of the fine particles.

Other means to regulate the performance of the apparatus include, e.g., a regulation of the feed rate, the fineness of the feed and the spped of rotation of the blower. It may also be necessary to dry the feed material, to aerate it, to disperse it with dispersing agents and even to dry the pneumatic fluid before it is admitted into the classification chamber.

An example of the classification apparatus according to this ivention to accomplish separations can be seen from the results of the following experiment carried out on a pilot plant unit built substantially as shown in FIG. 1. In this unit, the diameter of the circular classification chamber was 700 mm. and its width 150 mm. The blower rotated at 2950 rpm driven by a 15 kW. motor and produced an air stream of 1.1 $m^3$ per second.

As a feed material, conventional rapid-quality cement was used. In one-step separation the results were:

| | Feed | Fine Product | Coarse Product |
|---|---|---|---|
| Processing rate, t/h | 5.4 | 1.15 | 4.25 |
| Weight distribution, % | 100 | 21.3 | 78.7 |
| Specific surface area, $cm^2/g$ | 4550 | 10400 | 3000 |
| Net energy used, kWh/t | 3.1 | 15 | |
| Fineness, −45 μm, % | 96.2 | 100.0 | 95.2 |
| −32 μm, % | 84.9 | 100.0 | 80.8 |
| −20 μm, % | 66.9 | 100.0 | 58.0 |
| −15 μm, % | 59.0 | >99.9 | 48.0 |

The invention has been shown in preferred form and by way of example only, and obviously many variations and modifications may be made therein within the spirit of the invention. The invention, therefore is not intended to be limited to any particular form or embodiment except to the extent that such limitations are expressly set forth in the claims.

I claim:

1. A pneumatic classifier for separating a finer and coarser product of a material to be classified comprising a classification chamber having a circular portion and an arcuate portion adjacent and in substantially open communication with the lower region of the circular portion for unobstructed flow of the coarser product from the circular to the arcuate portions, the arcuate portion having a tangential inlet and a tangential discharge and the unobstructed portion extending substantially from the inlet to the discharge, a blower introducing a stream of pneumatic fluid into the inlet of the arcuate portion to produce a swirling stream through the arcuate portion to the discharge thereof and around the circular portion to form an inner stream which merges with the inner portion of the incoming stream, separate means for feeding the material to be classified downwardly intermediate the circular and arcuate portions and intermediate the incoming and inner swirling streams, the feed being initially displaced downwardly into the arcuate portion between the merging stream while part of the incoming stream passes through the feed material to carry the finer particles into the circular portion while the coarser particles are carried outwardly through the unobstructed open communication between the circular and arcuate portions into the arcuate portion by centrifugal force, a fine particle discharge for receiving products discharged from the region within the circular portion within the swirling stream, a coarse product cyclone to receive the coarser particles discharged from the discharge of the arcuate portion, a fine product cyclone to receive the finer particles discharged from the circular portion of the chamber, return conduits connecting the upper regions of both cyclones with the intake of the blower, and adjustable flow control means in only the return conduit connecting the upper region of the coarse product cyclone and the intake of the blower and providing the principal control over the ratio of fine and coarse product separated in the chamber.

2. A pneumatic classifying process for separating a finer and coarser product in a classification chamber having a circular portion and an arcuate portion adjacent and in substantially open communication with the lower region of the circular portion for unobstructed flow of coarser product from the circular to the arcuate portions, the arcuate portion having a larger upwardly extending tangential inlet and a smaller tangential discharge, comprising the steps of introducing a stream of pneumatic fluid into the inlet end of the arcuate portion of the classification chamber to produce an outer swirling stream through the arcuate portion to the discharge thereof and an inner swirling stream around the circular portion which merges with the inner portion of the incoming stream, separately feeding the material to be classified downwardly intermediate the circular and arcuate portions of the chamber, the coarser particles of the feed material migrating in the arcuate portion by centrifugal force toward the outer portion of the stream and out the tangential discharge while the inner portion of the incoming stream penetrates the downwardly flowing material to separate the finer particles and direct them into the circular portion, swirling some coarser particles around the outer periphery of the circular portion of the classification chamber and back to the incoming stream through which the coarser particles migrate outwardly by centrifugal force toward the outer stream passing unhindered through the open communication between the circular and arcuate portions of the chamber, discharging the finer particles from the region of the circular portion within the swirling stream, directing the fine product into a fine product cyclone, directing the coarse product into a coarse product cyclone, returning the pneumatic fluid from the upper region of both the coarse product cyclone and the fine product cyclone to the intake of the source of the pneumatic fluid and regulating only the return flow from the coarse product cyclone and not the return flow from the fine product cyclone to provide the principal control over the ratio of fine and coarse product separated in the chamber.

3. A closed circuit pneumatic classifier comprising a classification chamber in which a material to be classified is swirled to separate the finer and the coarser particles, said classification chamber including a generally circular portion and an arucate portion adjacent and in substantially open communication with the lower region of the circular portion for relatively unobstructed flow of coarser particles from the circular to the arcuate portions, a tangential inlet to the arcuate portion and a tangential discharge therefrom, a single blower in the closed circuit for introducing a stream of pneumatic fluid into the tangential inlet to produce a main outer stream through the arcuate portion and out the tangential discharge, a separate downwardly directed feed means merging with the incoming stream of pneumatic fluid and introducing the material to be classified intermediate the circular and arcuate portions of the classification chamber, the coarser particles of the material migrating in the arcuate portion by centrifugal force toward the outer portion of the stream and out the tangential discharge and the finer particles being carried by the penetration of the inner part of the incoming stream through the downwardly flowing material into the circular portion, the stream swirling in a closed path within the circular portion and carrying coarser particles back to the outer stream through the open communication between the circular and arcuate portions of the chamber, a fine product discharge passage from the circular portion of the classifying chamber within the swirling stream, a fine product cyclone in unobstructed communication with the fine product discharge passage, a coarse product cyclone communicating with the coarse product tangential discharge from the arcuate portion of the chamber, return conduits establishing communication between the upper regions of the fine and coarse product cyclones and the intake of the blower and an adjustable control valve means in the return conduit from the coarse product cyclone and not in the return conduit from the fine product cyclone for regulating the ratio of fine and coarse product separated in the chamber while maintaining maximum air flow through and from the chamber.

* * * * *